US010059097B2

(12) United States Patent
Yoshikawa

(10) Patent No.: US 10,059,097 B2
(45) Date of Patent: Aug. 28, 2018

(54) IMAGE PROCESSING METHOD, IMAGE PROCESSING APPARATUS, AND PRINTING SYSTEM

(71) Applicant: SEIKO EPSON CORPORATION, Tokyo (JP)

(72) Inventor: Eishin Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/440,464

(22) Filed: Feb. 23, 2017

(65) Prior Publication Data

US 2017/0253026 A1 Sep. 7, 2017

(30) Foreign Application Priority Data

Mar. 1, 2016 (JP) ..... 2016-038655

(51) Int. Cl.
*B41J 2/045* (2006.01)
*B41J 2/21* (2006.01)

(52) U.S. Cl.
CPC ..... *B41J 2/04536* (2013.01); *B41J 2/04586* (2013.01); *B41J 2/2135* (2013.01)

(58) Field of Classification Search
CPC .... B41J 2/04541; B41J 2/2135; B41J 29/393; B41J 2/04505; B41J 2/04586; B41J 29/38; B41J 2/04501; B41J 2/04536
USPC ..... 347/9, 14, 19, 57
See application file for complete search history.

(56) References Cited

U.S. PATENT DOCUMENTS

| | | | |
|---|---|---|---|
| 2011/0216115 | A1 | 9/2011 | Sato et al. |
| 2012/0223994 | A1 | 9/2012 | Yuda et al. |
| 2013/0163010 | A1 | 6/2013 | Yoshida |

FOREIGN PATENT DOCUMENTS

| | | | |
|---|---|---|---|
| JP | 2011-183582 | A | 9/2011 |
| JP | 2012-179884 | A | 9/2012 |
| JP | 2013-132898 | A | 7/2013 |

*Primary Examiner* — Jannelle M Lebron

(57) ABSTRACT

A method of generating print data includes: generating dot map data in which pieces of ink droplet discharging data for creating dots forming a printed image are arranged, for respective nozzles, at positions corresponding to positions of the dots; performing first correction in which positions of the pieces of ink droplet discharging data in the dot map data are corrected in a scanning direction based on position shift information that indicates an amount of shift of actual dot positions from intended dot positions formed in accordance with the dot map data, and corrected dot map data is generated; and performing second correction in which the positions of the pieces of ink droplet discharging data in the corrected dot map data are corrected in the scanning direction based on the corrected dot map data and information about a combination of nozzles used for forming the printed image.

14 Claims, 12 Drawing Sheets

Dp
Dp x

IMAGE PROCESSING METHOD, IMAGE PROCESSING APPARATUS, AND PRINTING SYSTEM

BACKGROUND

1. Technical Field

The present invention relates to an image processing method of generating print data with which a printer performs printing on the basis of image data, an image processing apparatus that generates print data by the image processing method, and a printing system including the image processing apparatus.

2. Related Art

There is an ink jet printer that forms an image by discharging ink droplets while causing a nozzle row having a plurality of nozzles arranged in the same direction as a transport direction of a printing medium to reciprocally move in a direction (scanning direction) orthogonal to the direction of the nozzle row. In such an ink jet printer, when timing (discharging position) of discharging ink droplets onto the printing medium is shifted from predetermined timing (position) depending on positions of nozzles in the nozzle row (for example, a positional difference between nozzles positioned at a nozzle row center portion and nozzles positioned at nozzle row end portions), it is difficult to form a desired high-definition image (for example, extra-fine ruled line).

For example, JP-A-2011-183582 describes a printing method in which coordinates of dots formed by nozzles of a nozzle row center portion and coordinates of dots formed by nozzles of nozzle row end portions are measured with respect to a ruled line printed in advance along a transport direction by discharging ink from a plurality of nozzles, a shift amount in a scanning direction among the coordinates is calculated, and pixel data corresponding to the dots formed by the nozzles of the nozzle row end portions among pixel data indicating unit elements forming an image are shifted in the scanning direction in accordance with the shift amount to perform printing. According to the printing method, it is possible to correct shift in the scanning direction of an ink landing position occurring between the nozzle row end portions and the nozzle row center portion when the ruled line is printed.

In the printing method described in JP-A-2011-183582, however, since the correction is performed on a pixel position basis (pixel pitch basis), there is a problem that when an image is formed with a multipass method (a method in which an image is formed by partially overlapping passes with ink droplets being discharged multiple times while moving the nozzle row in the scanning direction), density unevenness or the like may become apparent due to position shift (correction residual) of less than the pixel pitch, which is difficult to be corrected, in a region where the plurality of passes are overlapped.

SUMMARY

An advantage of some aspects of the invention can be implemented as the following application examples or aspects.

Application Example 1

An image processing method according to this application example is the image processing method of generating print data with which a printer performs printing. The printer forms a printed image based on image data by using dots created by a plurality of nozzles that discharge ink droplets while the nozzles moving in a direction of scanning a printing medium. The image processing method includes: mapping, based on the image data, pieces of ink droplet discharging data for the respective nozzles for creating dots forming the printed image at positions corresponding to positions of the dots, to generate dot map data; performing first correction in which positions of the pieces of ink droplet discharging data in the dot map data are corrected in the scanning direction based on position shift information that indicates an amount of shift of actual dot positions from intended dot positions formed in accordance with the dot map data, and corrected dot map data is generated; and performing second correction in which the positions of the pieces of ink droplet discharging data in the corrected dot map data are corrected in the scanning direction based on the corrected dot map data and information about a combination of nozzles used for forming the printed image.

The image processing method of generating print data according to the application example includes: performing the mapping in which the dot map data is generated where the pieces of ink droplet discharging data for creating the dots forming the printed image are arranged, for each of the nozzles, at the positions corresponding to the positions of the dots based on the image data; performing the first correction in which the positions of the pieces of ink droplet discharging data in the dot map data are corrected in the scanning direction based on the position shift information for each of the nozzles, which indicates the shift amount of the actual dot positions relative to the intended dot positions at which dots are created in the scanning direction, and the corrected dot map data is generated; and performing the second correction in which the positions of the pieces of ink droplet discharging data in the corrected dot map data are corrected in the scanning direction based on the corrected dot map data that is generated through correction for each of the nozzles and the information about the combination of the nozzles used for forming the printed image.

According to the application example, by the first correction in which dot creation positions are corrected based on the position shift information which indicates the shift amount of the actual dot positions from the intended dot positions, the dot creation positions are corrected, for each of the nozzles, to be in an optimum range on a dot pitch basis. Since the second correction in which the positions of the pieces of ink droplet discharging data are corrected in the scanning direction based on the information about the combination of the nozzles used for forming the printed image is further included, it is possible to further perform optimum correction on a dot pitch basis. Specifically, even the correction of the positions on a dot pitch basis makes it possible to perform the correction with respect to a portion where the correction is further required depending on the combination of the nozzles, thus making it possible to generate print data allowing printing of a higher-quality printed image.

Application Example 2

In the image processing method according to the application example, the second correction includes determining correction necessity, for each of the nozzles, based on a residual of the corrected position of the piece of ink droplet discharging data with respect to the intended dot position, which is derived from the corrected dot map data for each of a plurality of nozzles creating the dots adjacent in the scanning direction, and in a case where it is determined that correction is necessary in the correction necessity determination, correction is performed based on the residuals.

According to the application example, since the second correction includes the correction necessity determination in which, based on the residual of the corrected position of the piece of ink droplet discharging data with respect to the intended dot position, which is derived from the corrected dot map data for each of a plurality of nozzles creating the dots adjacent in the scanning direction, necessity of correction for each of the nozzles is determined, more appropriate correction is able to be performed in a necessary and sufficient range. In addition, since the correction is performed based on each of the residuals of the plurality of nozzles in the second correction, it is possible to generate print data allowing printing of a higher-quality printed image.

Application Example 3

In the image processing method according to the application example, in the determining correction necessity, it is determined that correction is necessary in a case where the residual of one of the plurality of nozzles is a residual a and the residual of the other nozzle is a residual b and when magnitude of a difference between the residual a and the residual b exceeds 50% of an interval between the intended dot positions.

According to the application example, when the magnitude of the difference between the residual a of the corrected position of the ink droplet discharging data of one of nozzles creating dots adjacent in the scanning direction with respect to the intended dot position and the residual b of the corrected position of the ink droplet discharging data of the other nozzle with respect to the intended dot position exceeds 50% of the interval between the intended dot positions, it is determined that correction is necessary in the correction necessity determination. Therefore, the correction is performed when the correction of the positions on a dot pitch basis is effective, so that the correction is able to be performed more reliably.

Application Example 4

In the image processing method according to the application example, in the determining correction necessity, when it is determined that correction is necessary, a position of the ink droplet discharging data of the one nozzle is corrected by the interval between the intended dot positions in a direction in which the magnitude of the difference between the residual a and the residual b is equal to or less than 50% of the interval between the intended dot positions.

According to the application example, when it is determined that correction is necessary in the correction necessity determination, the position of the ink droplet discharging data of the one nozzle is corrected by the interval (a dot pitch) between the intended dot positions in a direction in which the magnitude of the difference between the residuals a and b is equal to or less than 50% of the interval between the intended dot positions. As a result, the interval between the dots adjacent in the scanning direction is further averaged in a direction closer to the interval between the intended dot positions, thus making it possible to generate print data allowing printing of a higher-quality printed image.

Application Example 5

An image processing apparatus according to the application example generates the print data in accordance with the image processing method according to the application examples.

According to the image processing apparatus of the application example, it is possible to generate print data with which a printer that forms a printed image based on image data by using dots created by a plurality of nozzles discharging ink droplets while the nozzles moving in the direction of scanning a printing medium performs printing of a higher-quality printed image.

Application Example 6

A printing system according to the application example includes the image processing apparatus according to the application examples, and the printer.

According to the application example, it is possible to perform printing of a higher-quality printed image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
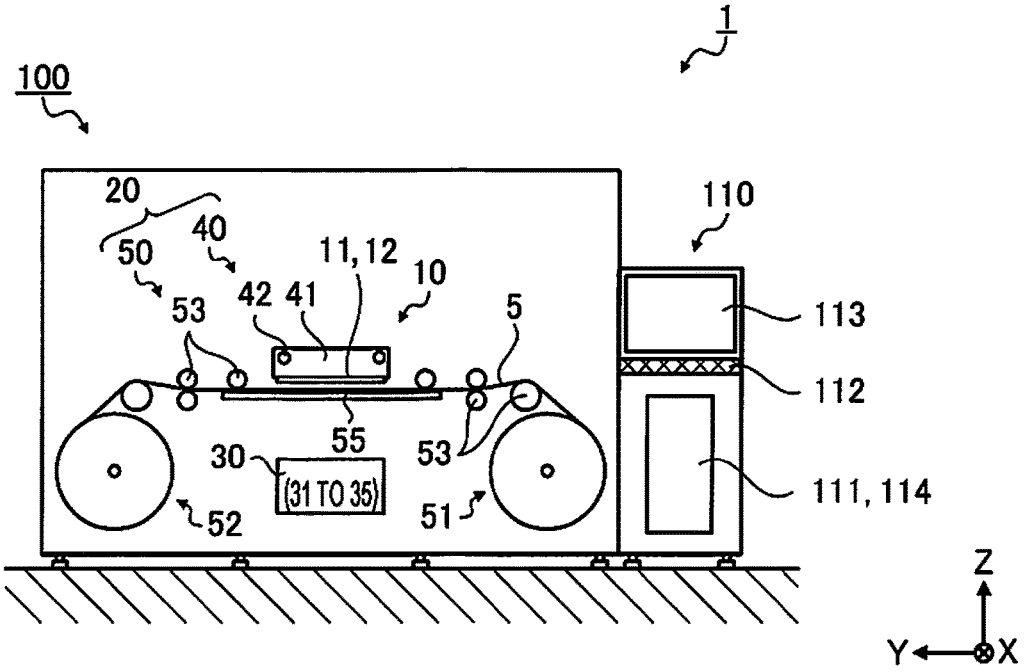
FIG. 1 is a front view illustrating a configuration of a printing system according to Embodiment 1.

Hereinafter, an embodiment of the invention will be described with reference to the drawings. The embodiment described below is an embodiment of the invention and does not limit the invention. In each of the following drawings, dimensions may be different from the actual dimensions in order for the description to be easy to understand. In coordinates in the drawings, a Z axis direction is an up and down direction and a +Z direction is an upward direction, an X axis direction is a front and rear direction and a −X direction is a front direction, a Y axis direction is a left and right direction and a +Y direction is a left direction, and an X-Y plane is a horizontal plane.

Embodiment 1

Printing System

Figure 2:
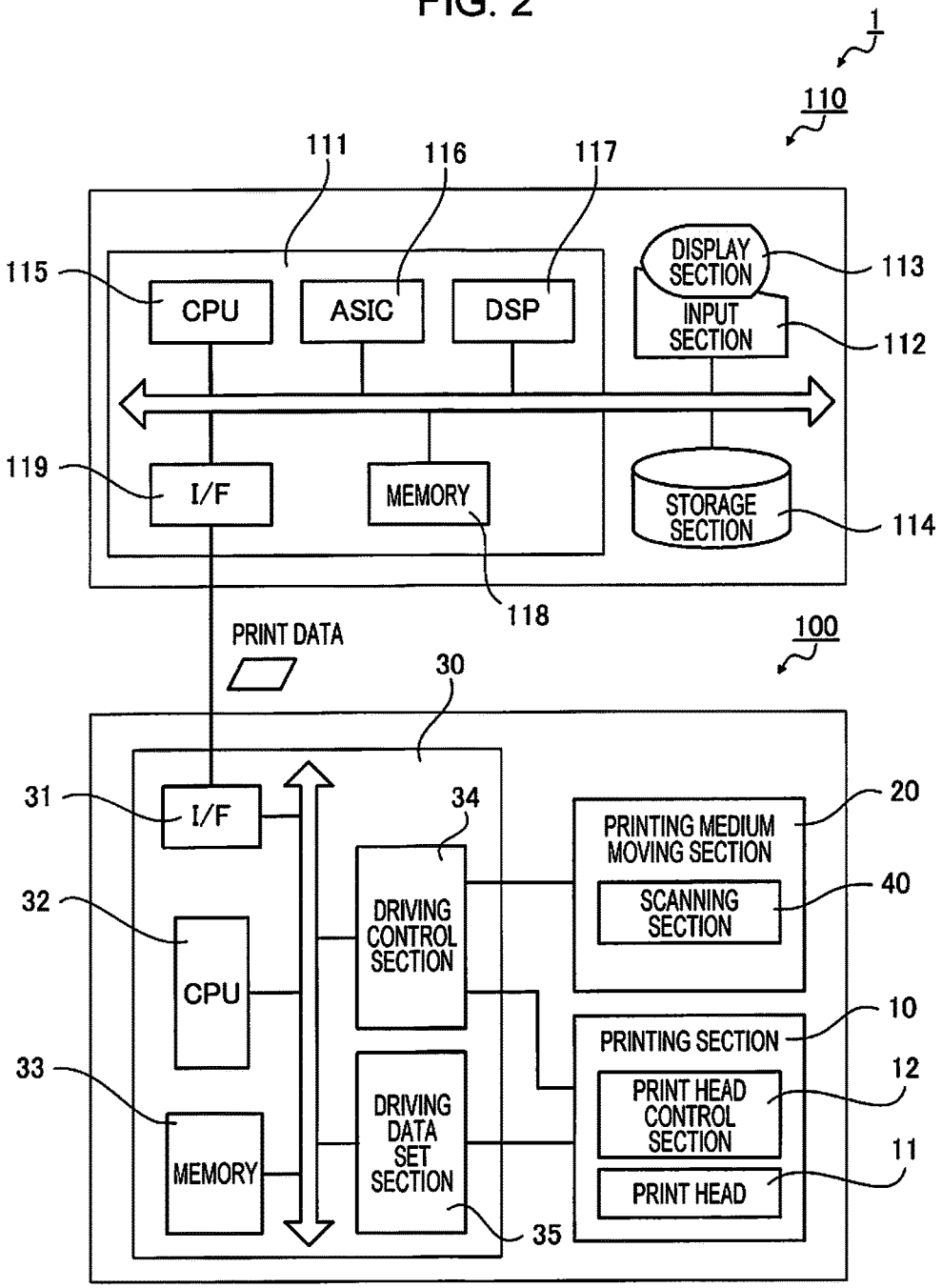
FIG. 2 is a block diagram of the printing system according to Embodiment 1.

FIG. 1 is a front view illustrating a configuration of a printing system 1 according to Embodiment 1, and FIG. 2 is a block diagram thereof.

The printing system 1 is constituted by a printer 100 and a personal computer 110 (hereinafter, referred to as a PC 110) as an "image processing apparatus" connected to the printer 100. The printer 100 is an ink jet printer that prints a desired image on an elongated printing medium 5 supplied in a state of being wound in a roll shape on the basis of print data received from the PC 110.

Basic Configuration of Image Processing Apparatus (PC 110)

The PC 110 includes a printer control section 111, an input section 112, a display section 113, a storage section 114, and the like, and controls a print job with which the printer 100 performs printing.

Software with which the PC 110 operates includes general image processing application software (hereinafter, referred to as an application) for handling image data subjected to printing and printer driver software (hereinafter, referred to as a printer driver) for controlling the printer 100 and generating print data with which the printer 100 performs printing.

The printer control section 111 includes a CPU (Central Processing Unit) 115, an ASIC (Application Specific Integrated Circuit) 116, a DSP (Digital Signal Processor) 117, a memory 118, a printer interface section 119, and the like, and performs concentrated management of the whole of the printing system 1.

The input section 112 is an information input unit as a human interface. Specifically, the input section 112 is, for example, a keyboard, a port connected to an information input device, or the like.

The display section 113 is an information display unit (a display) as a human interface, and displays thereon information input from the input section 112, an image to be printed by the printer 100, information associated with a print job, and the like, under the control of the printer control section 111.

The storage section 114 is a rewritable storage medium, such as a hard disk drive (HDD) or a memory card, and stores therein software with which the PC 110 operates (a program that runs on the printer control section 111), an image to be printed, information associated with a print job, and the like.

The memory 118 is a storage medium that secures a region in which a program that is operated by the CPU 115 is stored, an operated work region, and the like, and is configured by memory elements such as a RAM and an EEPROM. Moreover, a "print data space" described below is formed in the memory 118.

Basic Configuration of Printer 100

The printer 100 is constituted by a printing section 10, a printing medium moving section 20, a control section 30, and the like. The printer 100 having received print data from the PC 110 controls the printing section 10 and the printing medium moving section 20 by the control section 30, and causes an image to be printed (formed) on the printing medium 5.

The print data is, for example, data for image formation resulting from a conversion process, which is performed by the application and the printer driver that are included in the PC 110, for converting general image data (for example, RGB digital image information) acquired by a digital camera or the like so as to allow printing by the printer 100, and includes a command for controlling the printer 100.

The printing section 10 is constituted by a print head 11, a print head control section 12, and the like.

The printing medium moving section 20 is constituted by a scanning section 40, a transport section 50, and the like. The scanning section 40 is constituted by a carriage 41, a guide shaft 42, a carriage motor (not illustrated), and the like. The transport section 50 is constituted by a supply section 51, an accommodator 52, a transport roller 53, a platen 55, and the like.

The print head 11 has a plurality of nozzles (nozzle rows) for discharging ink for printing (hereinafter, referred to as ink) as ink droplets. The print head 11 is mounted on the carriage 41 and reciprocally moves, with the carriage 41 that moves in a scanning direction (the X axis direction illustrated in FIG. 1), in the scanning direction. When the print head 11 discharges ink droplets onto the printing medium 5, which is supported by the platen 55, under the control of the control section 30 while moving in the scanning direction, a dot row (raster line) is formed on the printing medium 5 along the scanning direction.

As an example of the ink, there is an ink set of four colors that is made by adding black (K) to an ink set of three colors of cyan (C), magenta (M), and yellow (Y), for example, as an ink set which is formed of dark ink compositions. Moreover, for example, there is also an ink set of eight colors that is made by adding, to the ink set of four colors, for example, an ink set of light cyan (Lc), light magenta (Lm), light yellow (Ly), and light black (Lk), which is formed of light ink compositions to lighten a concentration of each color material.

As a method (ink jet method) of discharging ink droplets, a piezo method is used as a suitable example. In the piezo method, a piezoelectric element (piezo element) exerts a pressure on ink stored in a pressure chamber in accordance with a printing information signal, and ink droplets are ejected (discharged) from nozzles that communicate with the pressure chamber, so that printing is performed.

Note that, the method of discharging ink droplets is not limited to the piezo method, and may be any other recording methods in which ink is ejected in a liquid drop condition and aggregates of dots are formed on a printing medium. For example, a method in which ink droplets are forcibly ejected by causing a small pump to apply a pressure to ink and causing a crystal oscillator or the like to mechanically oscillate a nozzle, a method (thermal jet method) in which ink droplets are ejected to perform recording by causing a minute electrode to heat and foam ink in accordance with a recording information signal, or the like may be used.

The printing medium moving section 20 (the scanning section 40 and the transport section 50) moves the printing medium 5 relative to the printing section 10 under the control of the control section 30.

The guide shaft 42 extends in the scanning direction and supports the carriage 41 so as to allow sliding. The carriage motor serves as a driving source for reciprocally moving the carriage 41 along the guide shaft 42. That is, the scanning section 40 (the carriage 41, the guide shaft 42, and the carriage motor) causes the carriage 41 (that is, the print heat 11) to move in the scanning direction along the guide shaft 42 under the control of the control section 30.

The supply section 51 rotatably supports a reel around which the printing medium 5 is wound in a roll form and feeds the printing medium 5 on a transport path. The accommodator 52 rotatably supports the reel around which the printing medium 5 is wound and winds the printing medium 5, on which printing has been completed, from the transport path.

The transport roller 53 is composed of a driving roller that moves the printing medium 5 in a transport direction (the Y axis direction illustrated in FIG. 1) crossing the scanning direction, a driven roller that rotates with the movement of the printing medium 5, and the like. The transport roller 53 constitutes a transport path on which the printing medium 5 is transported to the accommodator 52 via a printing region (a region where the print head 11 makes a scanning motion on an upper surface of the platen 55) of the printing section 10 from the supply section 51.

The control section 30 includes an interface section 31, a CPU 32, a memory 33, a driving control section 34, a driving data set section 35, and the like, and performs control of the printer 100.

The interface section 31 is connected to the printer interface section 119 of the PC 110 and exchanges data between the PC 110 and the printer 100.

The CPU 32 is a computer processing device for carrying out overall control of the printer 100.

The memory 33 is a storage medium that secures a region in which a program that is operated by the CPU 32 is stored, an operated work region, and the like, and is configured by memory elements such as a RAM and an EEPROM.

The CPU 32 controls the printing medium moving section 20 (the scanning section 40 and the transport section 50) and the printing section 10 (the print head 11) via the driving control section 34 in accordance with the program stored in the memory 33 and print data received from the PC 110, and successively delivers head driving data described below to the print head control section 12 via the driving data set section 35.

With the configuration described above, the control section 30 causes a desired image to be formed (printed) on the printing medium 5 by alternately repeating an operation of discharging ink droplets from the print head 11 onto the printing medium 5, which is supplied to the printing region by the transport section 50 (the supply section 51 and the transport roller 53), while moving the carriage 41, which supports the print head 11, in the scanning direction (the X axis direction) along the guide shaft 42 and an operation of moving the printing medium 5 in the transport direction (the +Y direction) crossing the scanning direction by the transport section 50 (the transport roller 53).

Basic Function of Printer Driver

Figure 3:
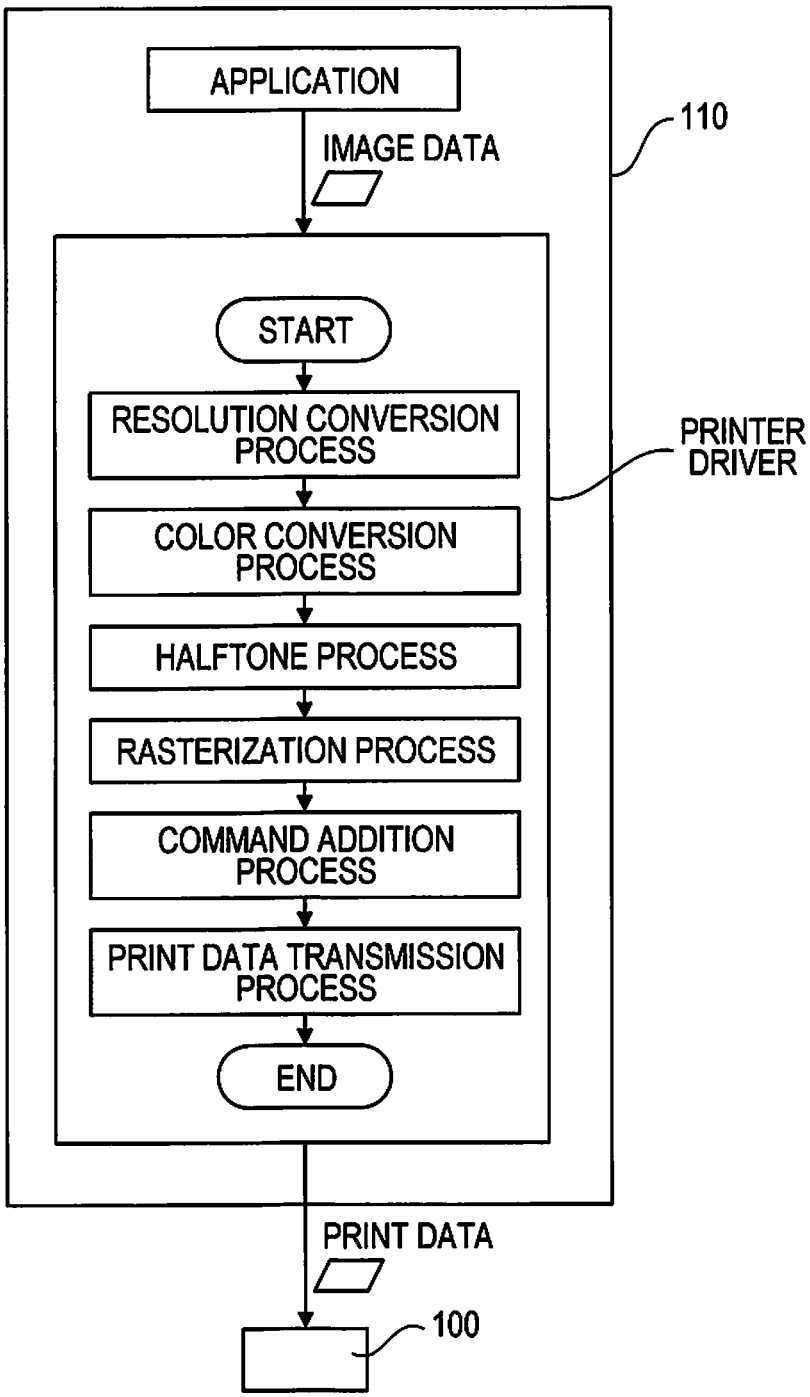
FIG. 3 is an explanatory view of a basic function of a printer driver.

FIG. 3 is an explanatory view of a basic function of the printer driver.

Printing on the printing medium 5 is started when print data is transmitted from the PC 110 to the printer 100. The print data is generated by the printer driver.

A process for generating the print data will be described below with reference to FIG. 3.

The printer driver receives image data (for example, text data, full-color image data, or the like) from the application, converts the image data to print data in a format that the printer 100 is able to interpret, and outputs the print data to the printer 100. When converting the image data received from the application to the print data, the printer driver performs a resolution conversion process, a color conversion process, a halftone process, a rasterization process, a command addition process, and the like.

The resolution conversion process is a process for converting a resolution of the image data output from the application to a resolution (print resolution) used when printing is performed on the printing medium 5. When the print resolution is specified to 720×720 dpi, for example, image data in a vector format that has been received from the application is converted to image data in a bitmap format having a resolution of 720×720 dpi. Each pixel data of the image data that has been subjected to the resolution conversion process is formed of pixels arranged in a matrix manner. Each pixel has a tone value of, for example, 256 gradations in an RGB color space. That is, the pixel data that has been subjected to the resolution conversion indicates a tone value in the corresponding pixel.

The pixel data corresponding to pixels arrayed in one row in a predetermined direction among the pixels arranged in a matrix manner is referred to as raster data. Note that, the predetermined direction in which the pixels corresponding to the raster data are arranged corresponds to a direction (scanning direction) in which the print head 11 moves when an image is printed.

The color conversion process is a process for converting RGB data to CMYK color space data. The CMYK colors are cyan (C), magenta (M), yellow (Y), and black (K). Image data in the CMYK color space is data corresponding to colors of ink that the printer 100 has. Thus, when the printer 100 uses ten types of inks in a CMYK color space, for example, the printer driver generates image data in ten dimensions of the CMYK color space on the basis of the RGB data.

The color conversion process is performed on the basis of a table (color conversion lookup table LUT) in which tone values in the RGB data correspond to tone values in the CMYK color data. Note that, the pixel data that has been subjected to the color conversion process is CMYK color data of 256 gradations expressed, for example, in the CMYK color space.

The halftone process is a process for converting data with the large number of gradations (256 gradations) to data with the number of gradations that the printer 100 is able to handle. With the halftone process, the data with 256 gradations is converted to 1-bit data with 2 gradations (dot present and non-dot) or 2-bit data with 4 gradations (non-dot, a small-sized dot, a medium-sized dot, and a large-sized dot). Specifically, a generation ratio of dots (for example, in the case of 4 gradations, a generation ratio of each of non-dot, a small-sized dot, a medium-sized dot, and a large-sized dot) corresponding to a tone value is obtained from a dot generation ratio table in which tone values (0 to 255) correspond to dot generation ratios, and pixel data is created by a dither method, an error diffusion method, and other methods so that dots are formed in a dispersed manner in the obtained generation ratio.

That is, the pixel data that has been subjected to the halftone process is 1-bit or 2-bit data, and is "ink droplet discharging data" according to one aspect of the invention for creating dots forming a printed image. The pixel data (ink droplet discharging data) serves as data indicating the creation of dots (presence or absence of dots and sizes of dots) in each pixel. For example, in the case of 2-bit data (with 4 gradations), the pixel data is converted to four levels; that is, a dot tone value [00] indicating that no dot is created, a dot tone value [01] indicating that a small-sized dot is created, a dot tone value [10] indicating that a medium-sized dot is created, and a dot tone value [11] indicating that a large-sized dot is created.

Figure 4:
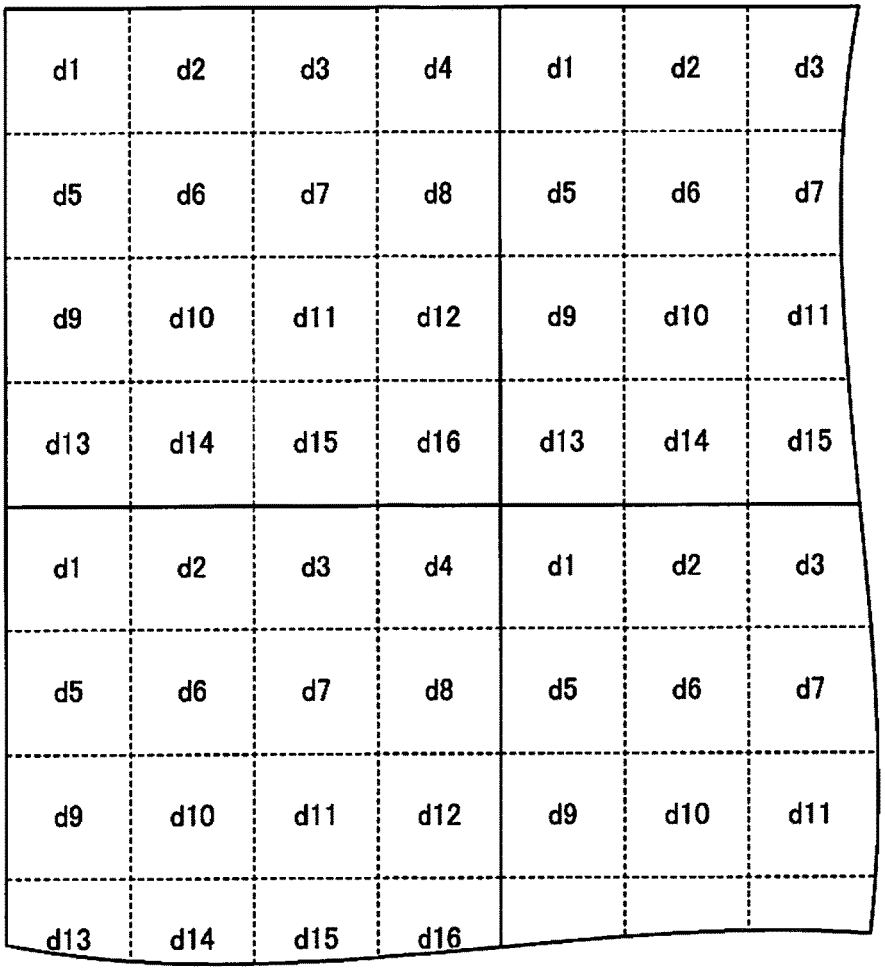
FIG. 4 is a conceptual diagram illustrating an example of arrangement of pixel data obtained as a result of performing a halftone process.

FIG. 4 illustrates an example of arrangement of the pixel data obtained as a result of performing the halftone process. The illustrated example indicates a result that image data with the large number of gradations (256 gradations) is developed to 2-bit data with a 4×4 matrix through the halftone process. This corresponds to one ink and the image data is developed to such 2-bit data for each ink color.

Each of d1 to d16 arranged in a 4×4 matrix is 2-bit data corresponding to a dot creation position and any of [00], [01], [10], and [11] obtained through the halftone process is provided to each of d1 to d16.

Note that, a case where the pixel data that has been subjected to the halftone process is 2-bit data (4 gradations: no dot, a small-sized dot, a medium-sized dot, and a large-sized dot) will be described below.

The rasterization process is a process for rearranging pixel data (2-bit data) arranged in a matrix manner in accordance with the order of dot creation upon printing. The rasterization process includes a pass allocation process for allocating image data formed by the pixel data that has been subjected to the halftone process to each pass in which the print head 11 (nozzle row) discharges ink droplets while making a scanning motion. When the pass allocation is completed, actual nozzles forming the raster lines that form a printed image are allocated.

An array of the pixel data in which rearrangement according to the order of dot creation upon printing is completed is "dot map data" according to one aspect of the invention. The dot map data is data obtained by arranging, for each nozzle, on the basis of image data, pieces of ink droplet discharging data for creating dots forming a printed image at positions corresponding to dot positions in a print data space. A step from the resolution conversion process to the rasterization process (pass allocation process) described above corresponds to a "mapping step" according to one aspect of the invention.

The command addition process is a process for adding command data according to a print scheme to the data that has been subjected to the rasterization process. An example of the command data includes transport data associated with transport specification (such as a motion amount in a transport direction, or a speed) of a medium.

The processes by the printer driver are performed by the ASIC 116 and the DSP 117 (refer to FIG. 2) under the control of the CPU 115, and the print data that has been generated is transmitted to the printer 100 via the printer interface section 119.

Nozzle Row

Figure 5:
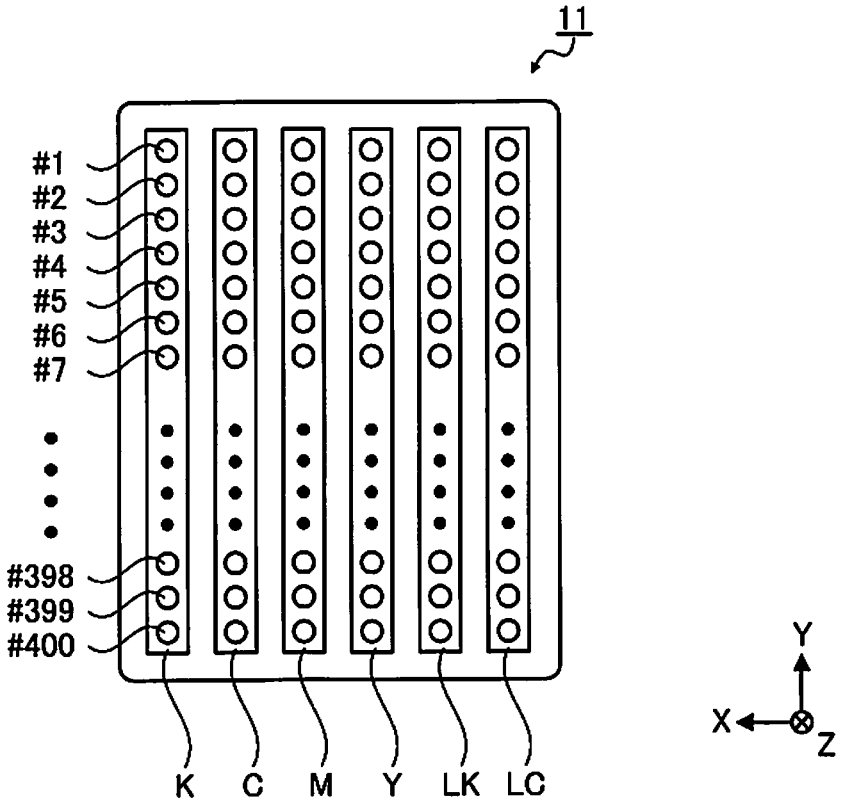
FIG. 5 is a schematic view illustrating an example of arrangement of nozzles when viewed from a bottom surface of a print head.

FIG. 5 is a schematic view illustrating an example of arrangement of nozzles when viewed from a bottom surface of the print head 11.

As illustrated in FIG. 5, the print head 11 includes nozzle rows (in the example illustrated in FIG. 5, a black ink nozzle row K, a cyan ink nozzle row C, a magenta ink nozzle row M, a yellow ink nozzle row Y, a gray ink nozzle row LK, and a light cyan ink nozzle row LC each of which is formed of 400 nozzles #1 to #400) in each of which a plurality of nozzles for discharging ink in respective colors are arrayed.

Though the nozzle rows are configured to be arrayed precisely in the Y axis direction orthogonal to the scanning direction (X axis direction), positions of dots to be created by ink droplets discharged by nozzles may be shifted from designed ideal positions (intended dot positions) due to variations in precision of processing for creating nozzles, assembly precision of the nozzle rows, precision of mounting the print head 11, or the like.

Figure 6:
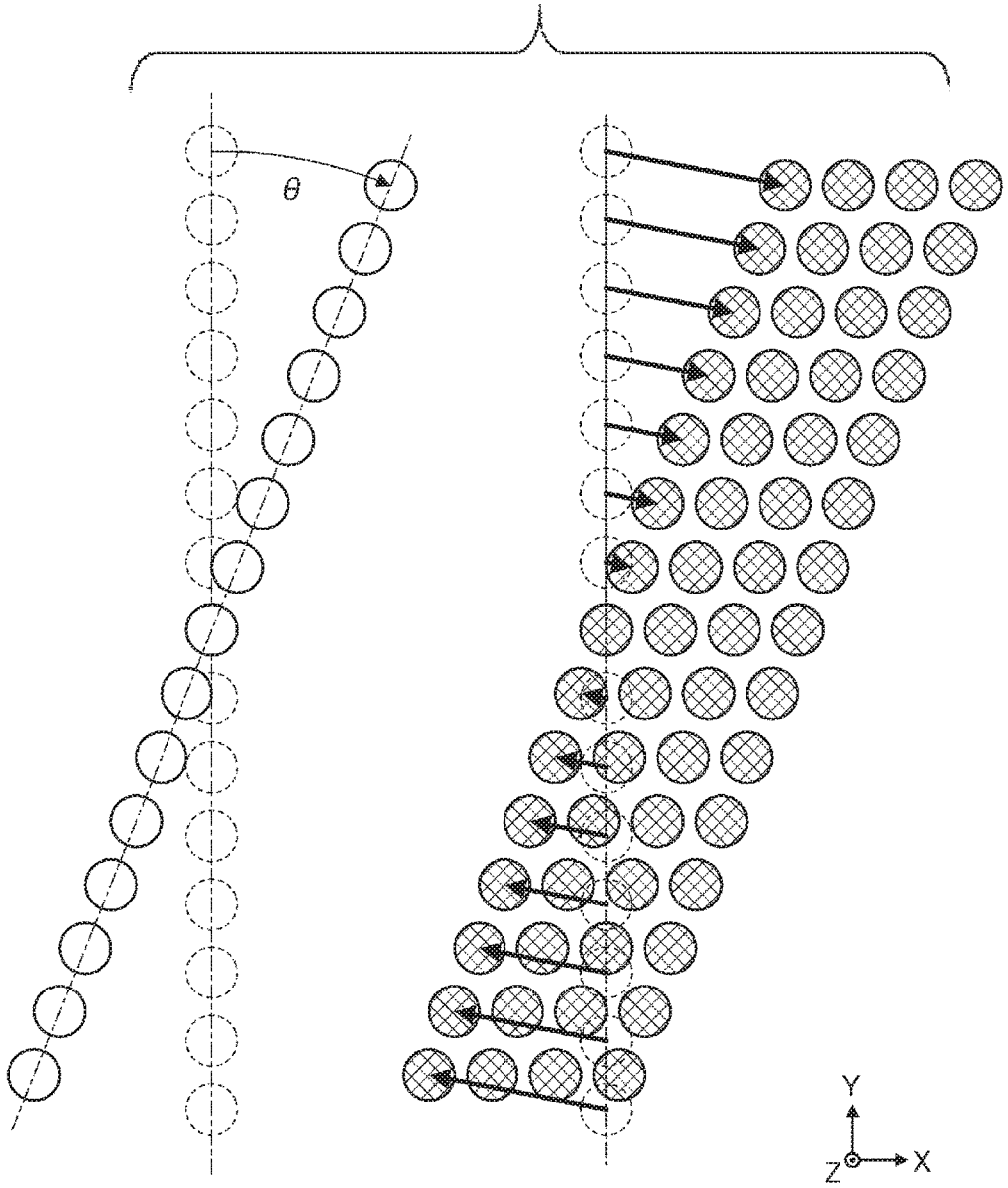
FIG. 6 is a schematic view illustrating an example when a nozzle row is attached obliquely at an angle θ in relation to a Y axis direction.

For example, FIG. 6 illustrates an example when a nozzle row is attached obliquely at an angle θ in relation to the Y axis direction. FIG. 6 indicates an example illustrating the nozzle row attached obliquely at the angle θ in relation to the Y axis direction and four dot rows created when the nozzle row discharges ink droplets while moving in the scanning direction (X axis direction).

Correction of Dot Creation Positions

Shift of dot creation positions from intended dot positions is able to be corrected to some extent by changing timing of discharging ink droplets. The correction of the discharging timing is performed by correcting the dot map data that has been subjected to the pass allocation process in the printer driver of the PC 110 (image processing apparatus). Specifically, the correction of the discharging timing is performed by shifting positions of pieces of ink droplet discharging data in the dot map data. In the present embodiment, printing with higher quality is able to be performed by performing a second correction step characterizing the present embodiment in addition to a first correction step according to a related art described below.

Note that, the description will be given with an example in which a nozzle row is formed of fifteen nozzles for the description to be easy to understand. Further, since the inclination θ actually has quite a small value, a change in a dot interval in the Y axis direction caused by the inclination θ is not considered.

First Correction Step

Description will be given with an example in which shift of dot positions in the scanning direction (X axis direction), which is caused as a result of the nozzle row being attached obliquely in relation to the Y axis direction as illustrated in FIG. 6, is corrected.

At the first correction step, on the basis of "position shift information" for each nozzle, which indicates a shift amount of actual dot positions relative to intended dot positions at which dots are created in the scanning direction, correction for correcting positions of pieces of ink droplet discharging data in the scanning direction on the dot map data and corrected dot map data is generated.

The position shift information (the shift amount of the actual dot positions relative to the intended dot positions in the scanning direction (X axis direction)) for each nozzle is able to be obtained by actually forming dot rows on the printing medium 5 for measurement in advance. Specifically, for example, dot rows formed by discharging one shot of ink droplets from all the nozzles are created for each nozzle row at an interval in the Y axis direction (while moving the printing medium 5 in a stepwise manner) and an image of the plurality of formed dot rows is analyzed, for example, by obtaining dot centroid coordinates by an image process, so that the position shift information is able to be obtained. For example, in a case where it is found that a variation in positions of nozzles in the nozzle row and a variation in the discharging direction of ink droplets are negligibly small, a method in which coordinates of dots created by nozzles at nozzle row end portions are measured and coordinates of other dots are calculated from data of the coordinates to thereby derive a shift amount from the intended dot positions may be used, for example.

Figure 7:
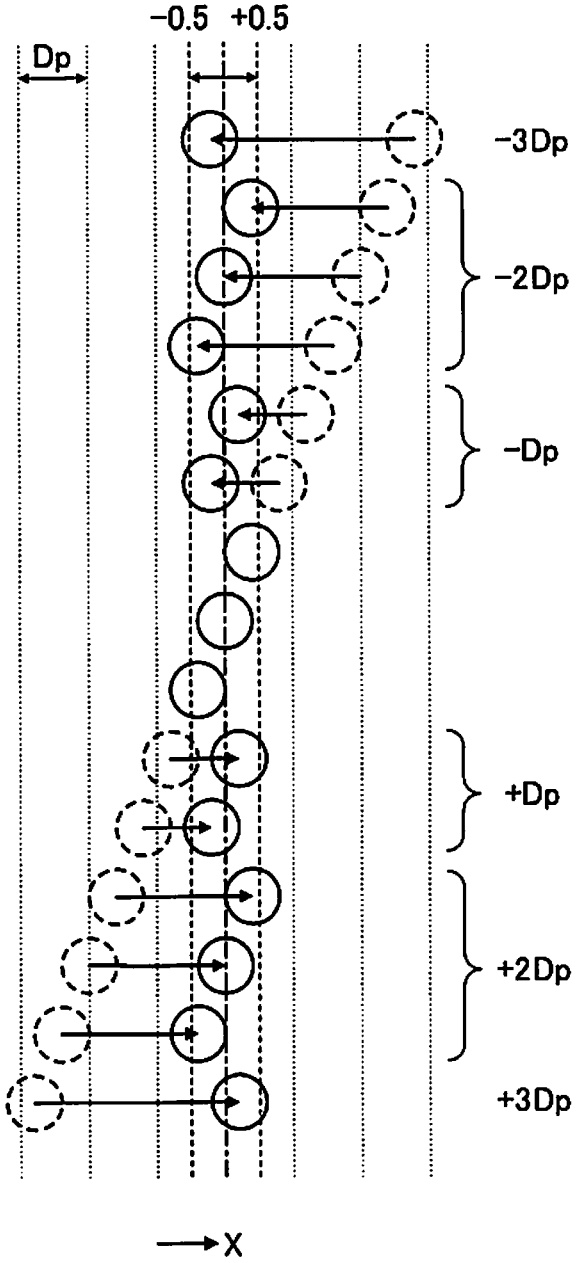
FIG. 7 is a conceptual diagram illustrating a correction amount when positions of pieces of ink droplet discharging data are corrected in dot map data.

FIG. 7 is a conceptual diagram illustrating a correction amount when the positions of the pieces of ink droplet discharging data are corrected in the dot map data on the basis of the obtained position shift information.

As illustrated in FIG. 7, with respect to the shift amount (position shift information) caused by the inclination, the positions are able to be made close to the intended dot positions on a pixel pitch (dot pitch Dp) basis in the scanning direction (X axis direction). The example illustrated in FIG. 7 indicates a situation where when pixels at both end portions, six pixels inside thereof (i.e. each three pixels on an inner side of each of the pixels at the end portions), and four pixels further inside thereof (i.e. each two pixels on a further inner side of each of the pixels at the end portions) are made closer to the intended dot positions by 3 Dp, 2 Dp, and 1 Dp, respectively, correction is able to be performed so that dot center positions are within a range of ±0.5 Dp relative to the intended dot positions. Note that, the dot pitch Dp is an interval between the intended dot positions (hereinafter, also referred to as an ideal pitch Dp).

Figure 8:
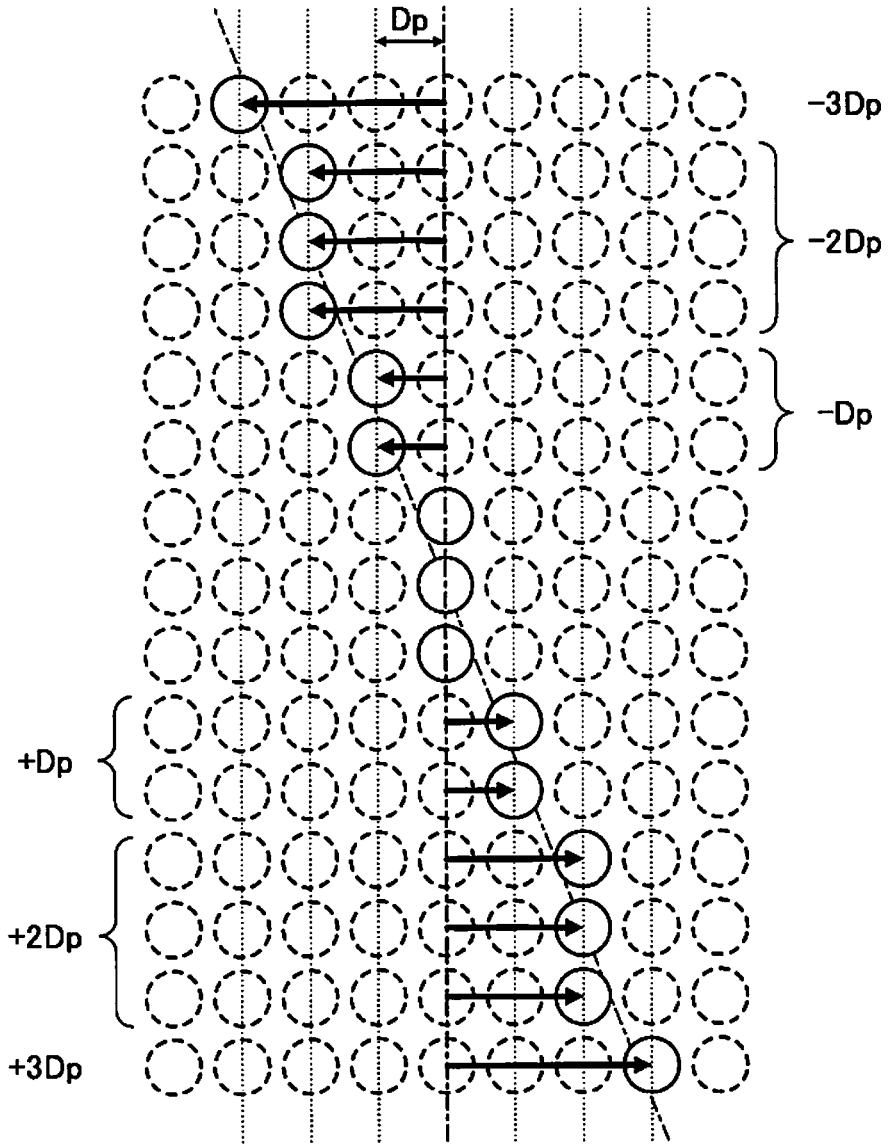
FIG. 8 is a conceptual diagram illustrating a situation where positions of pieces of ink droplet discharging data are corrected in a print data space.

FIG. 8 is a conceptual diagram illustrating a situation where the positions of the pieces of ink droplet discharging data are corrected in a print data space (dot map data).

The correction of the positions of the pieces of ink droplet discharging data at the first correction step is performed by shifting, for each nozzle, the positions of the pieces of ink droplet discharging data in an array of the raster line direction altogether by an amount of correction (that is, by the number of pieces of the data) on the aforementioned pixel pitch (dot pitch Dp) basis in the print data space of each nozzle row as illustrated in FIG. 8.

The dot map data that has been subjected to the correction is obtained as corrected dot map data.

Figure 9:
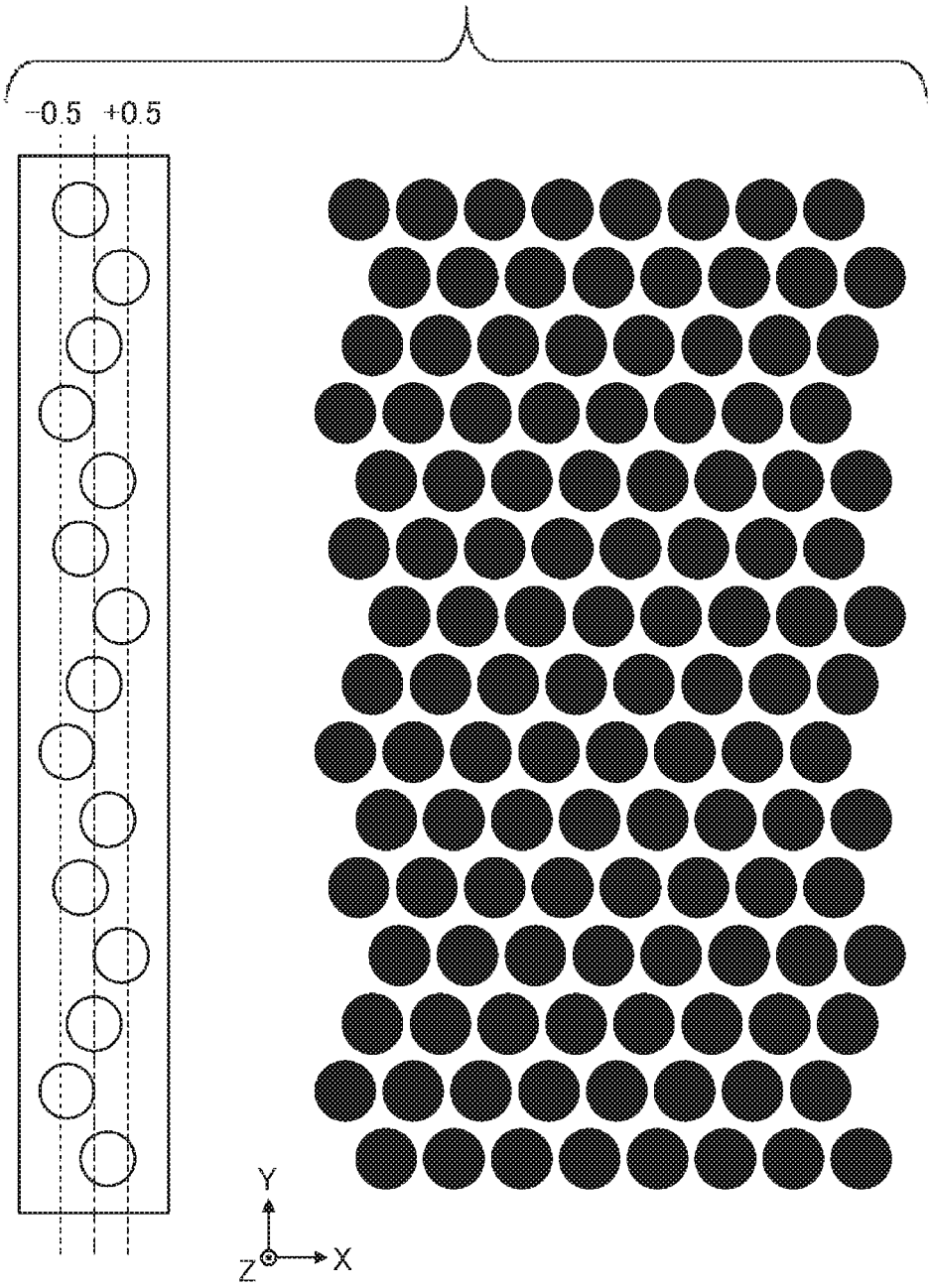
FIG. 9 is an explanatory view of an example illustrating virtual arrangement of a dot row corrected by a first correction step and eight dot rows created when the nozzle row discharges ink droplets while moving in a scanning direction (X axis direction).
Figure 10:
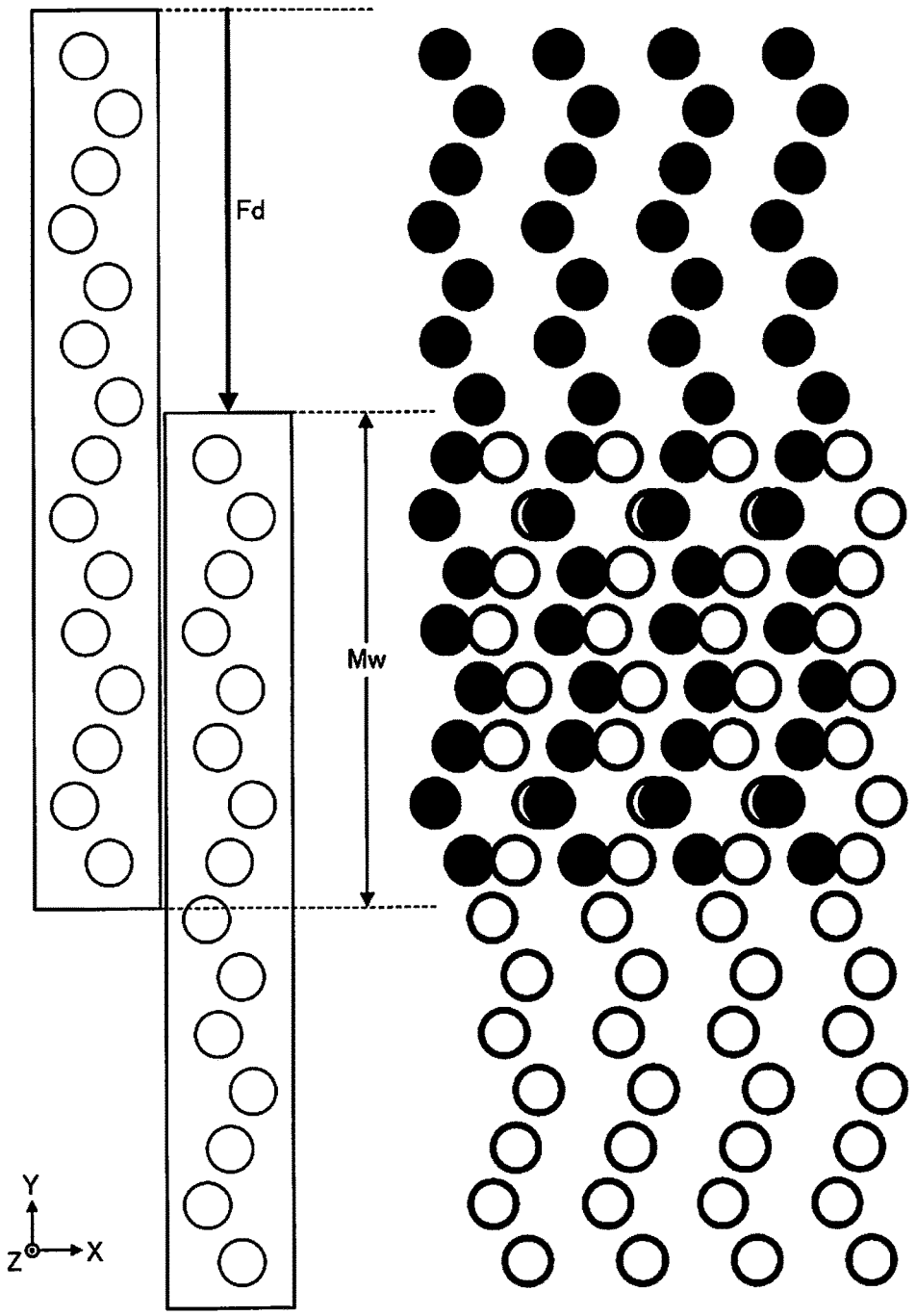
FIG. 10 is an explanatory view illustrating an example of eight dot rows when printing is performed with a multipass method by using the dot row corrected by the first correction step.

FIG. 9 indicates an example illustrating virtual arrangement of a dot row corrected by the first correction step and eight dot rows created when the nozzle row discharges ink droplets while moving in the scanning direction (X axis direction). FIG. 10 illustrates an example of eight dot rows when printing is performed with a multipass method by using the dot row corrected by the first correction step.

When an image in a width of a nozzle row (a length of the nozzle row in the Y axis direction) is formed only by one nozzle row as illustrated in FIG. 9, the pitch of dots arranged in the scanning direction is fixed and a high-quality image is able to be formed. On the other hand, when an image in a width over the width of the nozzle row is formed with the multipass method to avoid banding by the nozzle row, a variation is generated in the pitch of dots arranged in the scanning direction, for example, as illustrated in FIG. 10 to cause a part where printing quality is deteriorated.

An image formation method illustrated in FIG. 10 is a printing method in which there is a region Mw where an image is formed with two passes, and is a method in which dots are created every other dot in the first pass, and the printing medium 5 is then moved by a feeding amount Fd and dots are created so as to fill spaced dot portions in the next pass. In the region Mw where the image is formed with two passes, there is a variation in the pitch of dots arranged in the scanning direction and printing quality is deteriorated. This is because there is a variation (correction residual) in the dot center positions relative to the intended dot positions within a range of ±0.5 Dp so that the shift of the pitch of dots becomes apparent up to about 1 Dp at most depending on a combination of dots.

In the present embodiment, the second correction step of further adding correction to the corrected dot map data is provided in order to suppress deterioration in printing quality in a region formed with the multipass method.

Second Correction Step

At the second correction step, on the basis of the corrected dot map data that is generated through the correction for each nozzle by the first correction step and information about the combination of nozzles used for forming a printed image, the positions of the pieces of ink droplet discharging data in the corrected dot map data are further corrected in the scanning direction.

The information about the combination of nozzles used for forming a printed image refers to information about a combination of nozzles used for forming an image with the multipass method as described above and a relation of positions of the nozzles, and specifically information about a combination of nozzles creating dots adjacent in the scanning direction.

FIGS. 11A to 11D are conceptual diagrams for explaining a method of the correction at the second correction step.

In each example illustrated in FIGS. 11A to 11D, an image is formed with the multipass method by two nozzles (a nozzle A creating a dot indicated with a white circle and a nozzle B creating a dot indicated with a white circle with an X written therein). The left side from the center of each of FIGS. 11A to 11D illustrates an example of a positional relation on the X axis of dots created by the nozzles with respect to intended dot positions (ideal positions), and the right side indicates a situation where dots are created alternately by the nozzles. Note that, each figure on the left side illustrates the dots of the nozzles in an upper part and a lower part in a classified manner for easy understanding and there is no meaning in a positional relation of the dots in the vertical direction.

Figures 11A, 11B, 11C, 11D:
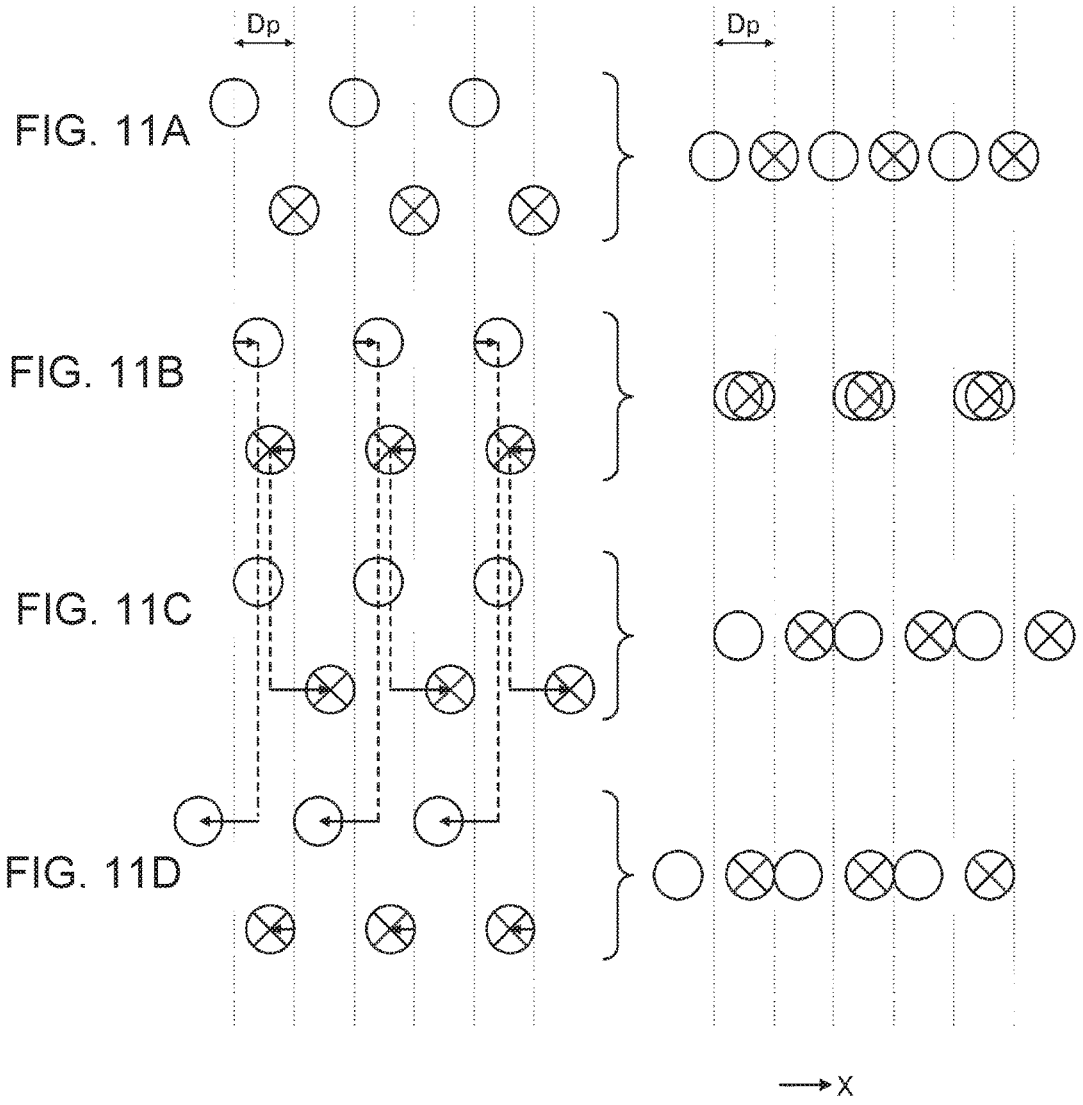
FIGS. 11A to 11D are conceptual diagrams for explaining a method of correction at a second correction step.

The state of FIG. 11A indicates the situation where dots alternately created by the nozzles A and B are created at intended dot positions (ideal positions), and FIG. 11B illustrates the situation where the dots by the nozzle A are created being shifted in the +X direction by 0.4 (0.4 Dp, hereinafter also referred to as 0.4 pitch) from the ideal pitch Dp and the dots by the nozzle B are created being shifted in the −X direction by 0.4 pitch.

FIG. 11B indicates that the shift amount from the intended dot positions is corrected to be within ±0.5 pitch by the first correction step, but residuals (residuals of the corrected dot positions with respect to the intended positions) are in opposite directions so that the dots are overlapped with each other (not necessarily overlapped depending on a dot size, but in close contact with each other).

FIG. 11C illustrates a result of correcting the overlapping of the dots due to the residuals by the second correction step. Specifically, correction for shifting the positions of the pieces of ink droplet discharging data of the nozzle B, which are shifted in the −X direction by 0.4 pitch, (that is, correction for shifting the dot creation positions in the +X direction by 1 Dp, in other words, correction for shifting the positions of the pieces of ink droplet discharging data in the +X direction by one piece on the dot map data) is performed.

While FIG. 11C indicates the correction for shifting the positions of the pieces of ink droplet discharging data of the nozzle B in the positive direction, FIG. 11D indicates a result of the correction for the nozzle A. That is, the correction for shifting the positions of the pieces of ink droplet discharging data of the nozzle A, which are shifted in the +X direction by 0.4 pitch, in the negative direction (that is, correction for shifting the dot creation positions in the −X direction by 1 Dp, in other words, correction for shifting the positions of the pieces of ink droplet discharging data in the −X direction by one piece on the dot map data) is performed.

In this manner, at the second correction step, the correction for further shifting as necessary, by referring to the corrected dot map data of nozzles creating adjacent dots, the positions of the pieces of ink droplet discharging data in a direction in which an interval between the dots becomes more uniform is performed.

The second correction step will be specifically described below by taking a case where a raster line is formed by two nozzles as an example.

Figure 12:
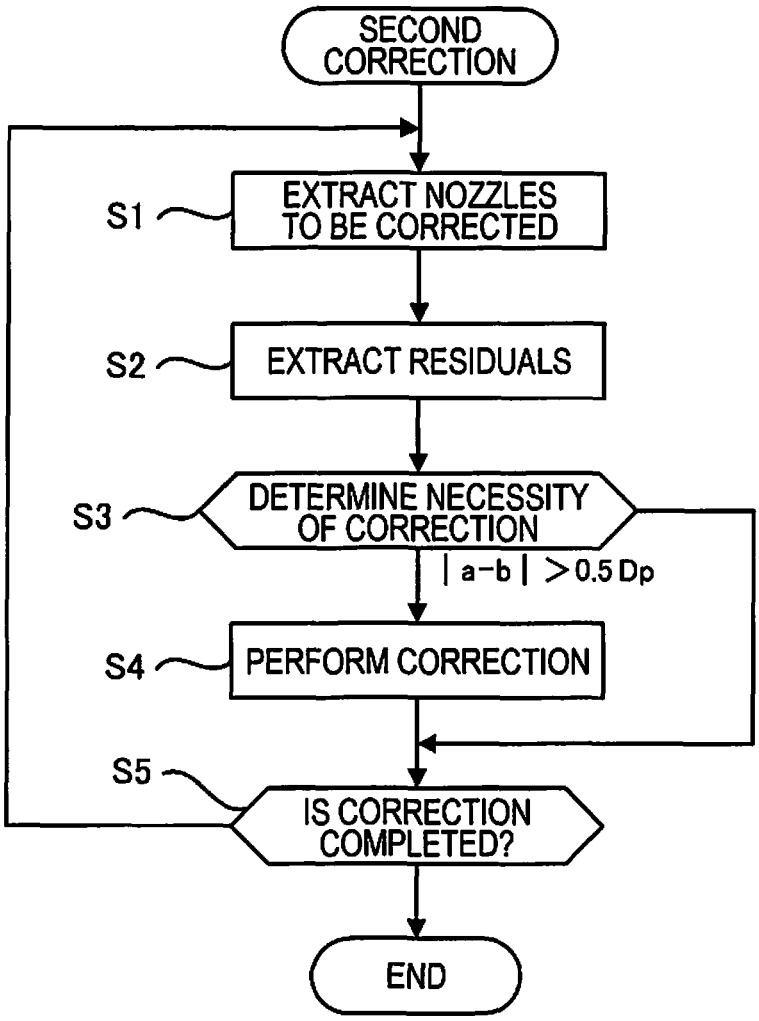
FIG. 12 is a flowchart of the second correction step.

FIG. 12 is a flowchart of the second correction step.

First, nozzles (two nozzles used for forming a raster line) to be corrected are extracted (step S1). As described above, by referring to dot map data that has been subjected to the pass allocation process after the halftone process, nozzles used for forming each raster line are found. This serves as information about a combination of the nozzles used for forming a printed image in one aspect of the invention. The two nozzles used for forming the raster line are extracted in accordance with the information.

Then, values of residuals (residuals of corrected dot positions with respect to intended dot positions) of the extracted nozzles are extracted (step S2). Each of the residuals is able to be derived from position shift information (a shift amount of an actual dot position relative to the intended dot position, which is obtained through measurement) and a correction amount when corrected dot map data is generated. Note that, when the first correction step is completed, the residual is a remainder of dividing the position shift information (shift amount) by Dp and hence is able to be calculated only from the position shift information.

Next, necessity of correction is determined by referring to magnitude of the extracted residuals of the two nozzles (step S3). Specifically, it is determined that the correction is necessary when magnitude of a difference between residuals a and b exceeds 50% of an ideal pitch Dp (an interval between intended dot positions) (correction necessity determination step), in which the residual a is a value of the residual of one nozzle and the residual b is a value of the residual of the other nozzle.

When it is determined that correction is necessary at step S3, correction for shifting a position of ink droplet discharging data of one nozzle by the interval between the intended dot positions in a direction in which the magnitude of the difference between the residuals a and b is equal to or less than 50% of the ideal pitch Dp (that is, correction for shifting a dot creation position by 1 Dp, in other words, correction for shifting the position of the ink droplet discharging data of the corresponding nozzle by one piece on the dot map data) is performed (step S4).

For example, when the residual a=0.2 Dp and the residual b=0.6 Dp, the magnitude of the difference between the residuals a and b is 0.4 Dp and does not exceed 50% of the ideal pitch Dp, and hence the correction is not performed.

Moreover, when the residual a=−0.2 Dp and the residual b=0.6 Dp, the magnitude of the difference between the residuals a and b is 0.8 Dp and exceeds 50% of the ideal pitch Dp, and hence the correction is performed.

As the correction in such a case, correction by which the residual a=−0.2 Dp+DP=0.8 Dp is achieved or correction by which the residual b=0.6 Dp−DP=−0.4 Dp is achieved is effective, in each of which the magnitude of the difference between the residuals a and b after the correction is 0.2 Dp and does not exceed 50% of the ideal pitch Dp.

As described above, the nozzle to be corrected is able to be selected from any one of the two nozzles. This is explained by the fact that any of the methods of FIGS. 11C and 11D is able to be selected as described with reference to FIGS. 11A to 11D.

Note that, in a case where correction for nozzles in the same nozzle row is performed in the same direction, an image is shifted on a nozzle row basis at end portions in the scanning direction of the image, so that a result of the correction at the end portions is easily visualized. Thus, it is desired to prevent the corrected result from becoming apparent, for example, by alternately performing correction of the two nozzles, in which correction directions are different.

A similar process is sequentially performed for each of the raster lines, and when the correction for all the raster lines is completed, the second correction step is completed (step S5).

As described above, with the image processing method, the image processing apparatus, and the printing system according to the present embodiment, the following effects are achieved.

By the first correction step in which dot creation positions are corrected on the basis of position shift information which indicates a shift amount of actual dot positions relative to intended dot positions, the dot creation positions are corrected, for each of nozzles, to be in an optimum range on a dot pitch basis. Further, since the second correction step in which positions of pieces of ink droplet discharging data are corrected in the scanning direction on the basis of information about a combination of nozzles used for forming a printed image is included, it is possible to further perform optimum correction on a dot pitch basis. Specifically, even the correction of the positions on a dot pitch basis makes it possible to perform the correction with respect to a portion where the correction is further required due to the combination of the nozzles, thus making it possible to generate print data allowing printing of a higher-quality printed image.

Further, since the second correction step includes the correction necessity determination step in which, on the basis of residuals of the corrected positions of the pieces of ink droplet discharging data with respect to the intended dot positions, which are derived from corrected dot map data for each of a plurality of nozzles creating dots adjacent in the scanning direction, necessity of correction for each of the nozzles is determined, more appropriate correction is able to be performed in a necessary and sufficient range. In addition, since the correction is performed on the basis of each of the residuals of the plurality of nozzles in the second correction step, it is possible to generate print data allowing printing of a higher-quality printed image.

When magnitude of a difference between the residual a of the corrected position of the ink droplet discharging data of one of nozzles creating dots adjacent in the scanning direction with respect to the intended dot position and the residual b of the corrected position of the ink droplet discharging data of the other nozzle with respect to the intended dot position exceeds 50% of an interval between the intended dot positions, it is determined that correction is necessary at the correction necessity determination step. Therefore, the correction is performed when the correction of the positions on a dot pitch basis is effective, so that the correction is able to be performed more reliably.

In a case where it is determined that correction is necessary in the correction necessity determination step, the position of the ink droplet discharging data of the one nozzle is corrected by an interval (a dot pitch) between the intended dot positions in a direction in which the magnitude of the difference between the residuals a and b is equal to or less than 50% of the interval between the intended dot positions. As a result, the interval between the dots adjacent in the scanning direction is further averaged in a direction closer to the interval between the intended dot positions, thus making it possible to generate print data allowing printing of a higher-quality printed image.

According to the PC 110 (image processing apparatus), it is possible to generate print data in accordance which the printer 100 that forms a printed image based on image data by using dots created by a plurality of nozzles discharging ink droplets while moving in the direction of scanning the printing medium 5 performs printing of a higher-quality printed image.

The printing system 1 includes the PC 110 and the printer 100, and hence is able to perform printing of a higher-quality printed image.

It is to be noted here that the invention is not limited to the aforementioned embodiment, and various modifications and improvements can be made on the aforementioned embodiment. A modification example will be described below. In the modification example, constituent portions that are the same as those of the aforementioned embodiment are denoted by the reference signs, and duplicated descriptions thereof are omitted.

Modification Example

Though the second correction step has been described in the aforementioned embodiment with the example in which a raster line is formed by two nozzles, the basic idea is the same also in a case of the multipass method in which the raster line is formed by three or more nozzles. However, there is also a case where as a result of performing the correction process at the second correction step with use of the aforementioned algorithm in a relation between specific two nozzles, a positional relation with dots formed by other adjacent nozzles becomes worse. Accordingly, in the case of the multipass method in which the raster line is formed by three or more nozzles, correction processes by the second correction step in all the assumed combinations are performed, and in accordance with results thereof, a determination process for selecting the correction in which a variation in an interval of dots in the raster line to be formed is the smallest is performed.

This application claims priority under 35 U.S.C. § 119 to Japanese Patent Application No. 2016-038655, filed Mar. 1, 2016. The entire disclosure of Japanese Patent Application No. 2016-038655 is hereby incorporated herein by reference.

What is claimed is:

1. An image processing method of generating print data with which a printer performs printing, the printer forming a printed image based on image data by using dots created by a plurality of nozzles that discharge ink droplets while the nozzles moving in a direction of scanning a printing medium, the image processing method comprising:

mapping, based on the image data, pieces of ink droplet discharging data for the respective nozzles for creating dots forming the printed image at positions corresponding to positions of the dots, to generate dot map data;

performing first correction to generate corrected dot map data in which the dot map data, which has been generated in the mapping, is corrected, the performing of the first correction including correcting the dot map data by correcting positions of the pieces of ink droplet discharging data in the dot map data in the scanning direction, based on position shift information that indicates an amount of shift of actual dot positions from intended dot positions formed in accordance with the dot map data; and performing second correction after the performing of the first correction, the performing of the second correction including the correcting corrected dot map data, which has been generated in the first correction, by correcting the positions of the pieces of ink droplet discharging data in the corrected dot map data in the scanning direction, based on the corrected dot map data and information about a combination of nozzles used for forming the printed image.

2. The image processing method according to claim 1, wherein the performing of the second correction further includes determining correction necessity for each of the nozzles, based on a residual of the corrected position of the piece of ink droplet discharging data with respect to the intended dot position, which is derived from the corrected dot map data for each of a plurality of nozzles creating the dots adjacent in the scanning direction, wherein in response to determining that correction is necessary in the correction necessity determination, the correcting of the corrected dot map data includes the correcting of the corrected dot map data based on the residuals.

3. The image processing method according to claim 2, wherein in the determining correction necessity, it is determined that correction is necessary in a case where the residual of one of the plurality of nozzles is a residual a and the residual of the other nozzle is a residual b and when magnitude of a difference between the residual a and the residual b exceeds 50% of an interval between the intended dot positions.

4. The image processing method according to claim 3, wherein in the determining correction necessity, when it is determined that correction is necessary, a position of the ink droplet discharging data of the one nozzle is corrected by the interval between the intended dot positions in a direction in which the magnitude of the difference between the residual a and the residual b is equal to or less than 50% of the interval between the intended dot positions.

5. The image processing method according to claim 2, wherein the performing of the second correction further includes extracting a residual a of one of the plurality of nozzles and a residual b of the other nozzle of the plurality of nozzles, and the determining of the correction necessity includes determining that correction is necessary in response to magnitude of a difference between the residual a and the residual b exceeding 50% of an interval between the intended dot positions.

6. The image processing method according to claim 5, wherein in response to determining that correction is necessary, the correcting of the corrected dot map data in the second correction includes correcting a position of the ink droplet discharging data of the one of the plurality of nozzles by the interval between the intended dot positions in a direction in which the magnitude of the difference between the residual a and the residual b is equal to or less than 50% of the interval between the intended dot positions.

7. An image processing apparatus that generates the print data in accordance with the image processing method according to claim 1.

8. An image processing apparatus that generates the print data in accordance with the image processing method according to claim 2.

9. An image processing apparatus that generates the print data in accordance with the image processing method according to claim 3.

10. An image processing apparatus that generates the print data in accordance with the image processing method according to claim 4.

11. A printing system comprising:

the image processing apparatus according to claim 7; and the printer.

12. A printing system comprising:

the image processing apparatus according to claim 8; and the printer.

13. A printing system comprising:

the image processing apparatus according to claim 9; and the printer.

14. A printing system comprising:

the image processing apparatus according to claim 10; and the printer.

* * * * *